US011707396B2

(12) United States Patent
Brown et al.

(10) Patent No.: US 11,707,396 B2
(45) Date of Patent: Jul. 25, 2023

(54) MEDICAL DEVICE SUPPORT APPARATUS FOR LITTER

(71) Applicant: THE GOVERNMENT OF THE UNITED STATES, AS REPRESENTED BY THE SECRETARY OF THE ARMY, Fort Detrick, MD (US)

(72) Inventors: Mark Brown, Myersville, MD (US); Scott Walters, Gaithersburg, MD (US); Mark Easterday, Jefferson, MD (US); Jay Bartlett, Adamstown, MD (US); Jaime Lee, Winchester, VA (US)

(73) Assignee: The Government of the United States, as Represented by the Secretary of the Army, Fort Detrick, MD (US)

( * ) Notice: Subject to any disclaimer, the term of this patent is extended or adjusted under 35 U.S.C. 154(b) by 0 days.

(21) Appl. No.: 17/797,642

(22) PCT Filed: Mar. 3, 2021

(86) PCT No.: PCT/US2021/020663
§ 371 (c)(1),
(2) Date: Aug. 4, 2022

(87) PCT Pub. No.: WO2021/178533
PCT Pub. Date: Sep. 10, 2021

(65) Prior Publication Data

US 2023/0069784 A1 Mar. 2, 2023

Related U.S. Application Data

(60) Provisional application No. 62/985,968, filed on Mar. 6, 2020.

(51) Int. Cl.
*A61G 13/10* (2006.01)

(52) U.S. Cl.
CPC ..... *A61G 13/101* (2013.01)

(58) Field of Classification Search
CPC ..... F16B 2/065; F16B 7/0433; A61B 6/04; A61G 13/105; A61G 1/04; A61G 2203/78;

(Continued)

(56) References Cited

U.S. PATENT DOCUMENTS 2,483,920 A * 10/1949 Mclean ..... A47B 23/02 5/507.1
2,547,642 A * 4/1951 Heuser ..... A47B 23/02 5/507.1

(Continued)

*Primary Examiner* — Myles A Throop
(74) *Attorney, Agent, or Firm* — Leigh Z. Callander

(57) ABSTRACT

An apparatus for mounting and securing medical/surgical devices may be attached to a litter (40), The medical/surgical devices may include. for example, IV holders (186), aspirators (144). cardiac monitors (148) , defibrillators (150) , infusion pumps 152 (152), ventilators (146) and other devices. The apparatus frame assembly (10) includes rails (12), (14), (16), (18), (20), (46), (48), (50), (52) having cross-sections of standard surgical rails, for attachment of slidable rail clamps (84), (104). Medical device mounts (108), (110), (112) are attached to the slidable rail clamps. The medical device mounts have height and/or rotational adjustment to improve patient access and view. The apparatus may be mounted longitudinally anywhere along the litter to maximize access to the patient.

22 Claims, 17 Drawing Sheets

(58) Field of Classification Search
CPC .. A61G 7/0503; A61G 13/101; A47B 23/025; A47B 23/02
USPC ..... 5/507.1
See application file for complete search history.

(56) References Cited

U.S. PATENT DOCUMENTS

| | | | | |
|---|---|---|---|---|
| 2,678,792 | A * | 5/1954 | Gallion | A47B 23/02 5/503.1 |
| 2,703,265 | A * | 3/1955 | Wolfe | A47B 23/02 5/503.1 |
| 3,961,854 | A * | 6/1976 | Jaquet | F16B 2/12 403/68 |
| 4,287,622 | A | 9/1981 | Lane | |
| 7,731,141 | B2 * | 6/2010 | Schuerch | A61B 90/50 5/624 |
| 8,191,909 | B2 | 6/2012 | Livengood et al. | |
| 10,729,602 | B2 | 8/2020 | Smeed | |
| 10,898,394 | B2 * | 1/2021 | Sirkin | A61G 13/105 |
| 2003/0080267 | A1 * | 5/2003 | Eslick | F16B 2/065 248/229.1 |
| 2005/0223494 | A1 * | 10/2005 | Ambrose, III | A61G 13/101 5/658 |
| 2007/0157389 | A1 * | 7/2007 | Eriksson | A61G 1/0231 5/507.1 |
| 2007/0267556 | A1 * | 11/2007 | Herskovic | F16M 11/06 248/218.4 |
| 2009/0212535 | A1 | 8/2009 | Darling, III | |

* cited by examiner

DETAIL A
SCALE 2:1

DETAIL B
SCALE 2 : 1

MEDICAL DEVICE SUPPORT APPARATUS FOR LITTER

CROSS REFERENCE TO RELATED APPLICATIONS

The present application claims the benefit of priority of U.S. provisional patent application Ser. No. 62/985,968 filed on Mar. 6, 2020, which is expressly incorporated by reference herein.

STATEMENT OF GOVERNMENT INTEREST

The invention described herein may be manufactured, used and licensed by or for the United States Government.

BACKGROUND OF THE INVENTION

The invention relates in general to emergency medical care and in particular to apparatus for securely attaching medical/surgical devices to an injured person carrier, such as a litter or stretcher.

Every day people are injured, especially during armed conflicts, terrorism, accidents and natural disasters. The injuries may be serious and may require the injured person to be placed on a stretcher, litter or similar injured person carrier. An example of a litter is a NATO litter 40 shown in FIGS. 6D and 6E. The NATO litter 40 includes a pair of parallel poles 42, 44 and a fabric that forms a bed 43 extending between the poles. The poles may be made of, for example, wood or a metal such as aluminum. Sometimes the fabric that forms the bed is wrapped multiple times around all of or sections of the poles resulting in larger diameter areas in parts of or all of the poles.

The injured person may receive medical attention at or near the geographical site of the injury and then be transported via a litter by foot, land vehicle, air vehicle or other transporter to a medical treatment facility. The injured person may require treatment and/or surgery before being transported to a medical treatment facility. Sometimes one or more medical and/or surgical devices are required for treatment and/or surgery for the injured person prior to and/or while being transported to a medical treatment facility. Such medical and/or surgical devices may include, for example, IV poles, aspirators, cardiac monitors, defibrillators, infusion pumps, ventilators and other devices.

To keep such medical/surgical devices close to the injured person, the medical/surgical devices may be somehow associated with the injured patient carrier. In combat areas, the transport of an injured person on a litter may be by two people who are walking or running over rough terrain, by a helicopter or other air vehicle that is subject to unpredictable air currents, by a military ambulance over rough terrain, or combinations of such transporters. The resulting ride could therefore be subject to unforeseen air currents or rapid aircraft movements that cause the aircraft to drop suddenly, make rapid and sharp turns and otherwise continue on its journey to transport the injured person(s) to a medical facility as quickly as possible. Such rapid transporter movements require that the medical/surgical devices are secured against reacting to the sudden change of movements and directions by flying off into space and/or within the transport vehicle and possibly further injuring the injured person or injuring persons who are assisting the injured person and/or flying or driving the transporter.

A need exists for an apparatus for securely fixing a wide variety of medical/surgical devices to a litter and for transporting the litter along with the medical/surgical devices and the patient.

SUMMARY OF THE INVENTION

In one aspect, an apparatus for mounting medical devices includes a frame assembly having a pair of parallel rails fixed to at least two transverse rails extending between the pair of parallel rails. A pair of arm assemblies may be pivotally attached to opposing first and second ends of the pair of parallel rails.

Each arm assembly may include a pair of parallel arms with each arm including a clamp at a distal end for engaging a pole of a litter having a pair of parallel poles. Each arm assembly may include two transverse rails extending between the pair of parallel arms. Each arm may depend downwardly and normal to a respective one of the pair of parallel rails in an open position of the frame assembly and may extend parallel to the respective one of the pair of parallel rails in a folded position of the frame assembly.

A pair of retractable spring plungers may be inserted through respective openings in the first ends of the pair of parallel rails and through respective openings in proximal ends of the pair of parallel arms to lock the pair of parallel arms of the arm assembly at the first end of the parallel rails normal to the first ends of the parallel rails. A tensioner assembly may include a threaded rod with one end of the tensioner assembly pivotally attached to a lower one of the two transverse rails of the arm assembly at the second end of the pair of parallel rails and another end of the tensioner assembly disposed in a slotted receiver fixed to one of the at least two transverse rails extending between the pair of parallel rails.

The apparatus may further comprise the litter having the pair of parallel poles wherein each clamp engages one of the parallel poles. The parallel rails and transverse rails of the frame assembly may have cross-sections of North American standard surgical rails or of European standard surgical rails.

A swing stop pin may be fixed to each parallel rail to limit rotation of the arm assembly at the second end of the parallel rails to a position in a range of about five degrees to about twenty degrees past a position that is perpendicular to the parallel rails.

A rail clamp may include a channel shaped to engage and slide along the parallel rails and the transverse rails. The rail clamp may include a rail body having an internally threaded opening that engages an externally threaded fastener. The externally threaded fastener may include a contact disc at one end that presses against one of the parallel or the transverse rails to secure the rail clamp from sliding along the rails. The rail clamp may include a stud fixed to the rail body for attachment of medical devices.

A medical device rotation assembly may be rotatably fixed to the stud of the rail clamp. The rotation assembly may rotate 360 degrees on the stud. The rotation assembly may be constrained from vertical translation with respect to the stud. The rotation assembly may include a boss and a clamp pivotally connected by a dowel, a first pivot pin with a threaded opening disposed in the boss, a second pivot pin with an unthreaded opening disposed in the clamp and a threaded rod that engages the threaded opening in the first pivot pin and extends through the unthreaded opening in the second pivot pin to an outside of the clamp. Vertical translation may be constrained by lower inner diameter portions of the boss and the clamp engaging a lower portion of the stud which has a diameter that is smaller than a diameter of an adjacent portion of the stud.

The boss may include a top surface and the apparatus may further comprise a medical device mount fixed to the top surface. The medical device mount may be, for example, one of an infusion pump mount, a defibrillator/cardiac monitor mount and an aspirator/ventilator mount.

The apparatus may include an IV pole assembly fixed to the rail clamp. The IV pole assembly may include a lower pole fixed to the rail clamp, an externally threaded compression bushing fixed to the lower pole, an internally threaded compression sleeve that engages the externally threaded compression bushing, an upper pole slidable and rotatable in the lower pole and an IV upper weldment at a top of the upper pole.

The apparatus may include a tray assembly disposed on the second ends of the pair of parallel rails.

The aspirator/ventilator mount may include an angle mount weldment fixed to the top surface of the boss, a T-mount fitting fixed to the angle mount weldment, a threaded bolt extending through a threaded opening in the T-mount fitting, and a disc fixed to one end of the threaded bolt for tightening against an aspirator or ventilator.

The defibrillator/cardiac monitor mount may include a platform assembly fixed to the top surface of the boss, two hold downs fixed to the platform assembly, a pair of threaded platform pins that engage threaded openings in the platform assembly and a knob fixed to each of the pair of threaded platform pins.

The apparatus may include a defibrillator/cardiac monitor having a bottom surface wherein each hold down of the platform assembly includes an overhang that mates with a gap above a ledge in the bottom surface of the defibrillator/cardiac monitor. The platform pins may be received in holes in the bottom surface adjacent to the ledges. The platforms pins may be vertically translatable into the holes in the bottom surface by turning the knobs to thereby securely fasten the hold downs to the bottom surface of the defibrillator/cardiac monitor.

The infusion pump mount may include a pump pole with a base fixed with fasteners to the top surface of the boss and a pump yoke weldment fixed to a top surface of the pump pole.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel apparatus for mounting and securing medical/surgical devices may be attached to an injured person carrier, such as a litter or stretcher. The litter may be a NATO compliant litter. Medical devices needed for patient care may be attached to the apparatus. The medical devices may include, for example, IV holders, aspirators, cardiac monitors, defibrillators, infusion pumps, ventilators and other devices. The apparatus may be mounted anywhere longitudinally along the litter to thereby maximize access to the patient. The litter clamps of the novel apparatus are free of pinch points and allow tool-free adjustment. As a result, the clamps allow for greater litter variation (tolerance) with the ability to secure the apparatus onto the litter tool-free. Litter variation may be in the diameter of the litter poles and/or the distance between the litter poles. The novel apparatus does not have pins hanging from lanyards, which can interfere with patient access and get tangled with other equipment. There are no obstructions between the frame of the apparatus and the patient, thereby providing maximum patient clearance. The medical device clamps have height and/or rotational adjustment to improve patient access and view and medical device access and view.

The frame assembly may be made of standard surgical rails (North American or European). Rail clamps mounted on the standard surgical rails are used to interface with and mount various medical devices. Thus, the rails serve the dual functions of an integral structural member of the frame assembly and a member on which to mount the medical devices. The rails are standard in size and shape thereby enabling commercial off-the-shelf medical device clamps to be used. Other medical apparatus may also use standard size and shape rails so the rail clamps of this disclosure may be used with those other medical apparatus.

The rails may have notches integrated at key locations to facilitate flexibility in attaching additional rail clamps to the apparatus without the need to remove equipment already mounted on the apparatus. Some of the device mounting clamps include the ability to rotate and some of the device mounting clamps are height adjustable. The apparatus is collapsible for stowage and/or shipment. The medical device mounts are usable across various platforms that use standard surgical rails, including military treatment/surgical tables. This time-saving commonality feature provides life-saving options in treating and transporting wounded personnel.

The novel apparatus, fixed to a litter with a patient on the litter, is designed to fit in limited spaces in transport vehicles, such as Mine-Resistant Ambush Protected vehicles, tracked vehicles, fixed and rotary winged aircraft and other ground and air medical evacuation transportation platforms. The apparatus provides access to the patient and secures medical devices to the litter.

Figure 1B:
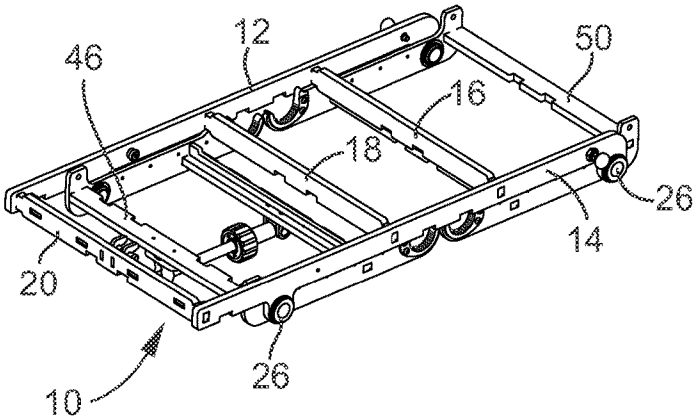
FIG. 1B is a perspective view of the frame assembly of FIG. 1 in a folded position.
Figure 1C:
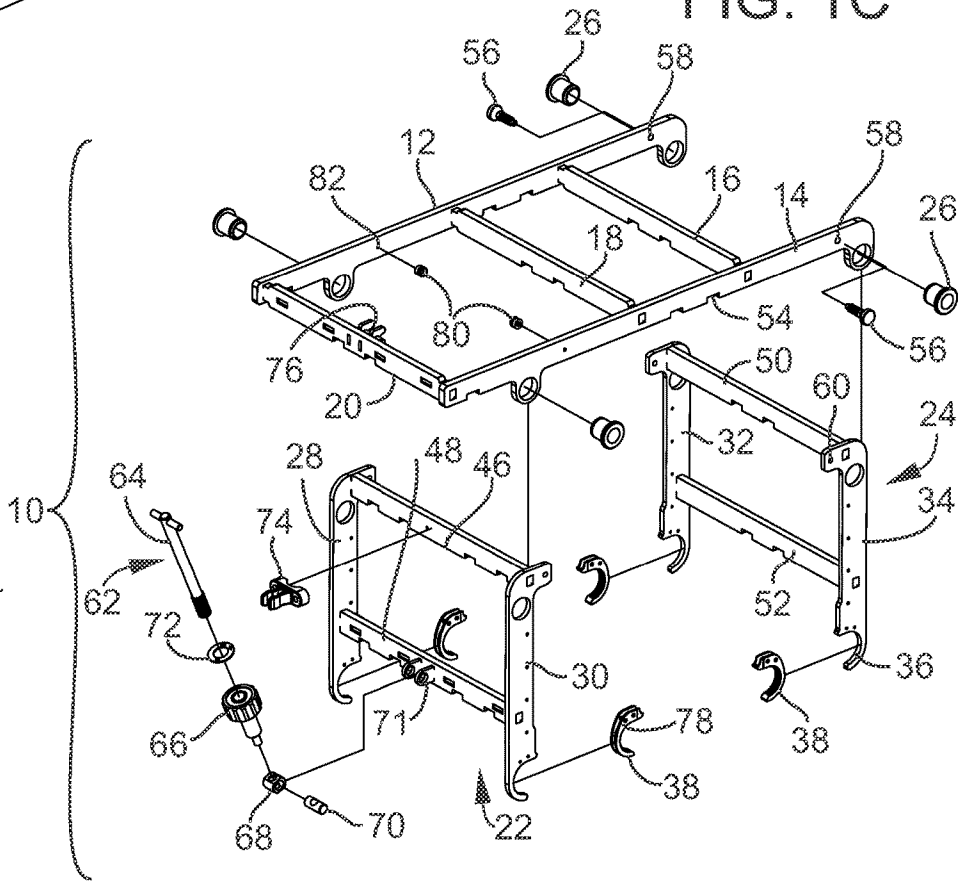
FIG. 1C is an exploded view of FIG. 1A.
Figure 1A:
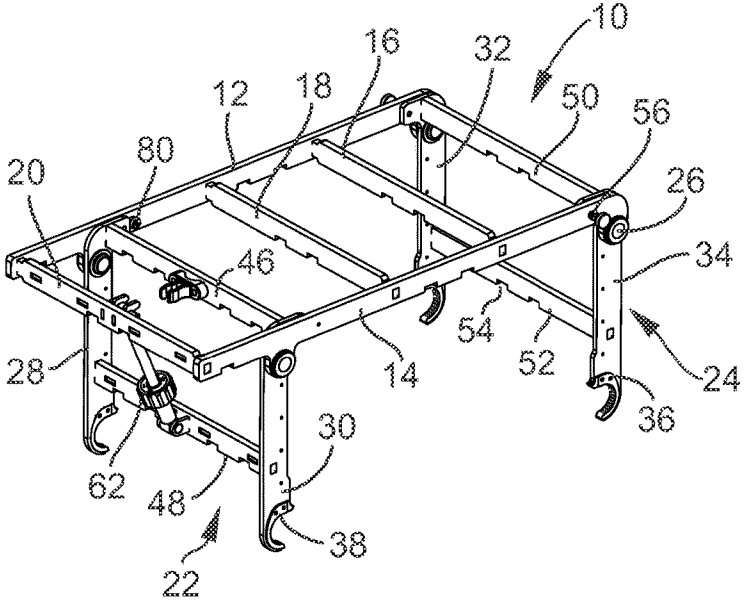
FIG. 1A is a perspective view of an embodiment of a frame assembly in an open position.

FIG. 1A is a perspective view of an embodiment of a frame assembly 10 in an open position. FIG. 1B is a perspective view of the frame assembly 10 of FIG. 1 in a folded position. FIG. 1C is an exploded view of FIG. 1A. Referring to FIGS. 1A-C, frame assembly 10 includes a pair of parallel rails 12, 14 fixed to at least two transverse rails extending between the pair of parallel rails 12, 14. In the embodiment shown in the Figs., there are three transverse rails 16, 18 and 20 although more than three may be used. A pair of arm assemblies 22, 24 are pivotally attached to opposite first and second ends of the pair of parallel rails 12, 14. Frame pivots 26 may be inserted in openings in the parallel rails 12, 14 and in openings in the arm assemblies 22, 24 to establish the pivotal relationship.

Each arm assembly 22, 24 may include a pair of parallel arms 28, 30 and 32, 34. Each arm 28, 30, 32, 34 may include a clamp 36 at a distal end for engaging a pole 42 or 44 of a litter 40 (FIGS. 6D and E) having a pair of parallel poles 42, 44. Clamps 36 may include clamp liners 38 with roughened surfaces to better grip litter poles 42, 44. Each clamp liner 38 has a concave surface 78 (FIG. 1C) for receiving a pole 42, 44 of the litter.

Each arm assembly 22, 24 may include two transverse arm rails 46, 48 and 50, 52 extending between the pair of parallel arms 28, 30 and 32, 34. Each arm 28-34 may depend downwardly and normal to a respective one of the parallel rails 12,14 in an open position (FIG. 1A) of the frame assembly 10 and extend parallel to the respective one of the parallel rails 12, 14 in a folded position (FIG. 1B) of the frame assembly 10.

Parallel rails 12, 14, transverse rails 16, 18, 20 and transverse arm rails 46, 48, 50, 52 preferably have cross-sections of either a North American standard surgical rail or a European standard surgical rail. The cross-section of the North American standard surgical table side rail is 1.125 inches by 0.375 inches. The cross-section of the European standard surgical rail is 25 mm by 10 mm. As is known in the art, notches 54 may be formed in the rails for ease of mounting and dismounting certain clamps and medical and surgical devices.

A pair of retractable spring plungers 56 may be inserted through respective openings 58 in the first ends of parallel rails 12, 14 and through respective openings 60 in proximal ends of the pair of parallel arms 32, 34 to lock the parallel arms 32, 34 normal to the first ends of parallel rails 12, 14.

A tensioner assembly 62 may include an externally threaded rod 64 that threadingly engages an internally threaded lower housing 66. Lower housing 66 is inserted in a pivot bushing 68 and pivot pin 70. Pivot pin 70 is inserted in a lower tab 71 thereby enabling tensioner assembly 62 to pivot with respect to a lower transverse rail 48. The other end of threaded rod 64 includes a T-handle that rests in a slotted receiver 76 fixed to transverse rail 20 extending between parallel rails 12, 14. A label 72 may be applied to tensioner lower housing 66 to indicate which direction to rotate lower housing 66 to lengthen or shorten tensioner assembly 62 to thereby loosen or tighten the clamps 36 against litter poles 42, 44.

A swing stop pin 80 may be fixed to each parallel rail 12, 14 to limit rotation of the arm assembly 22 at the second end of the parallel rails 12, 14. The stop pins 80 limit rotation of arm assembly 22 to a position in the range of about five to about twenty degrees past a position that is perpendicular to the parallel rails 12, 14. This prevents arm assembly 22 from pivoting too far outward from its litter rail when attaching the frame assembly 10 to the litter 40.

Figure 2B:
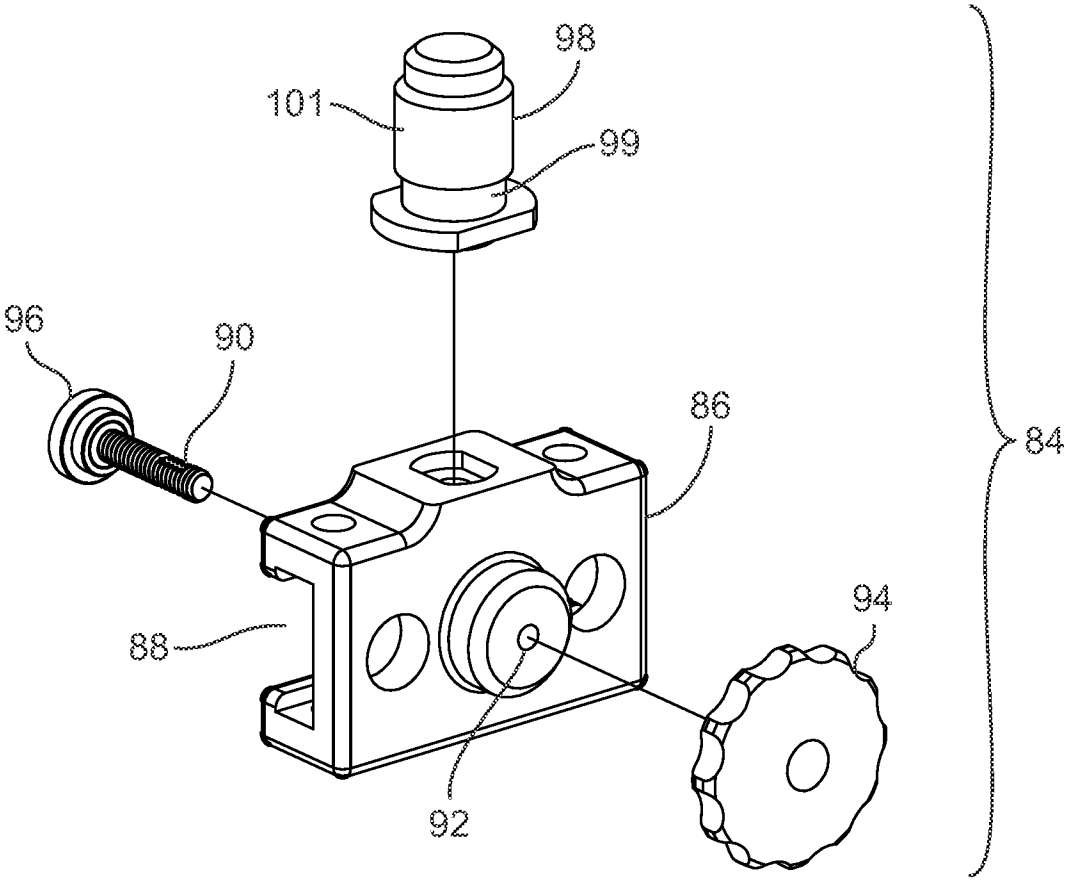
FIG. 2B is an exploded view of FIG. 2A.
Figure 2A:
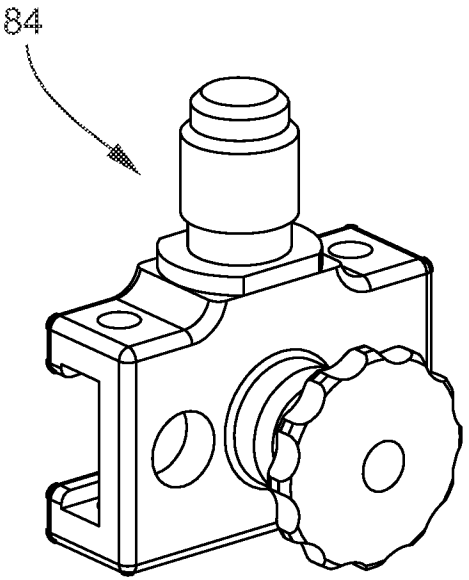
FIG. 2A is a perspective view of a rail clamp.
Figure 2C:
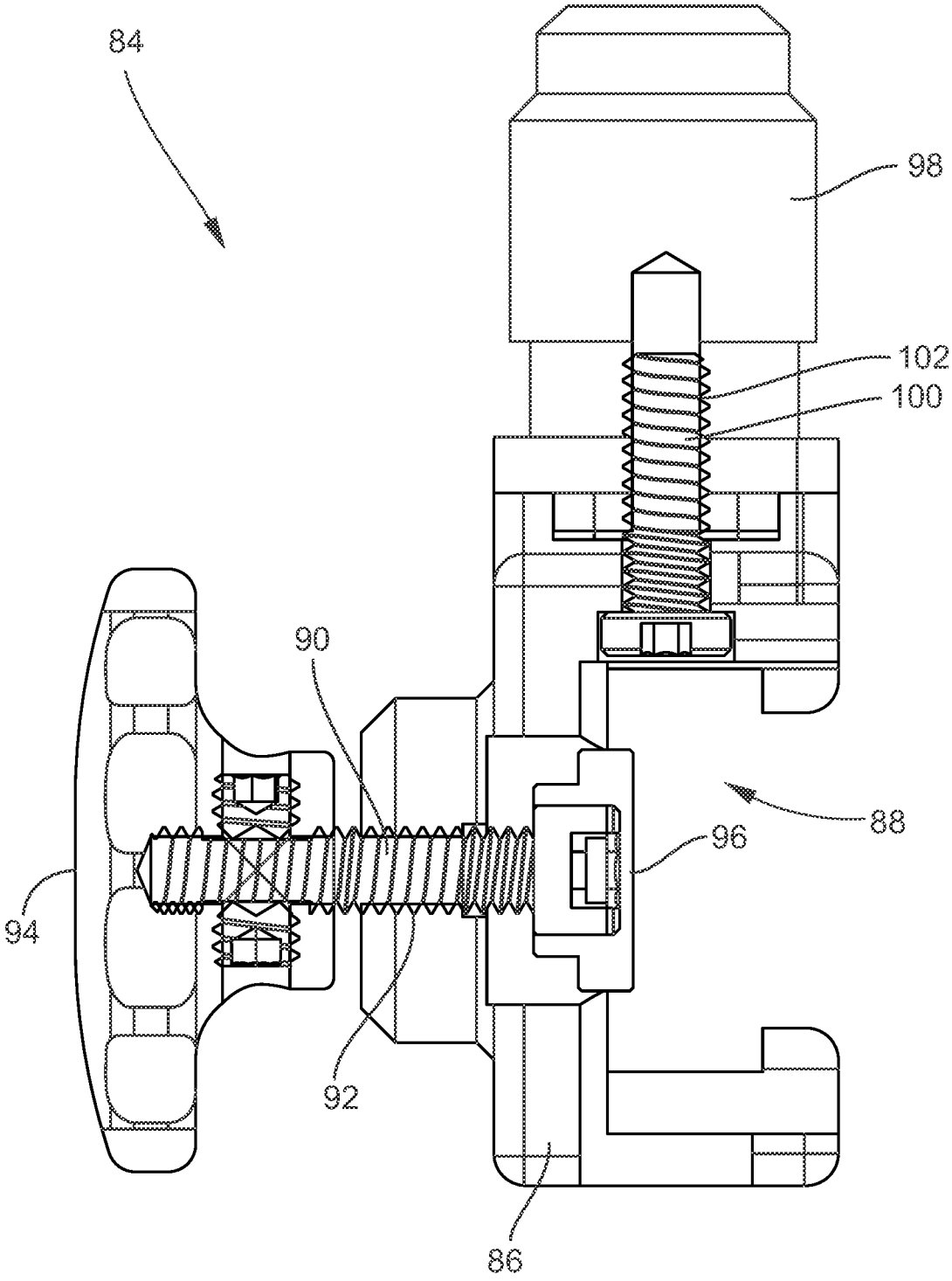
FIG. 2C is a transparent side view of FIG. 2A.

FIG. 2A is a perspective view of a rail clamp 84. FIG. 2B is an exploded view of FIG. 2A. FIG. 2C is a transparent side view of FIG. 2A. Rail clamp 84 includes a body 86 with a channel 88 formed therein. Channel 88 is shaped to engage and slide along the parallel rails 12, 14; the transverse rails 16, 18, 20; and the transverse arm rails 46, 48, 50, 52. Rail clamp 84 includes an externally threaded fastener 90 that engages internal threads in opening 92 in body 86. A knob 94 is fixed to one end of fastener 90 and a contact disc 96 is fixed to the other end of fastener 90 (see FIG. 2C). Depending on where rail clamp 84 is mounted, disc 96 may be tightened against one of rails 12, 14, one of transverse rails 16, 18, 20 or one of transverse arm rails 46, 48, 50, 52 to thereby secure rail clamp 84 to the rail and prevent the clamp 84 from sliding along the rail.

Rail clamp 84 also includes a stud 98 for receiving a medical device mount. Stud 98 includes an internally threaded portion 102 (FIG. 2C) that engages threaded fastener 100 to fix stud 98 to rail clamp body 86. As seen in FIG. 2B, a lower portion of stud 98 has a smaller diameter portion 99 compared to an adjacent larger diameter portion 101. As will be described below, portions 99 and 101 function to constrain vertical translation of medical device mounts rotatably fixed to stud 98.

Figure 3:
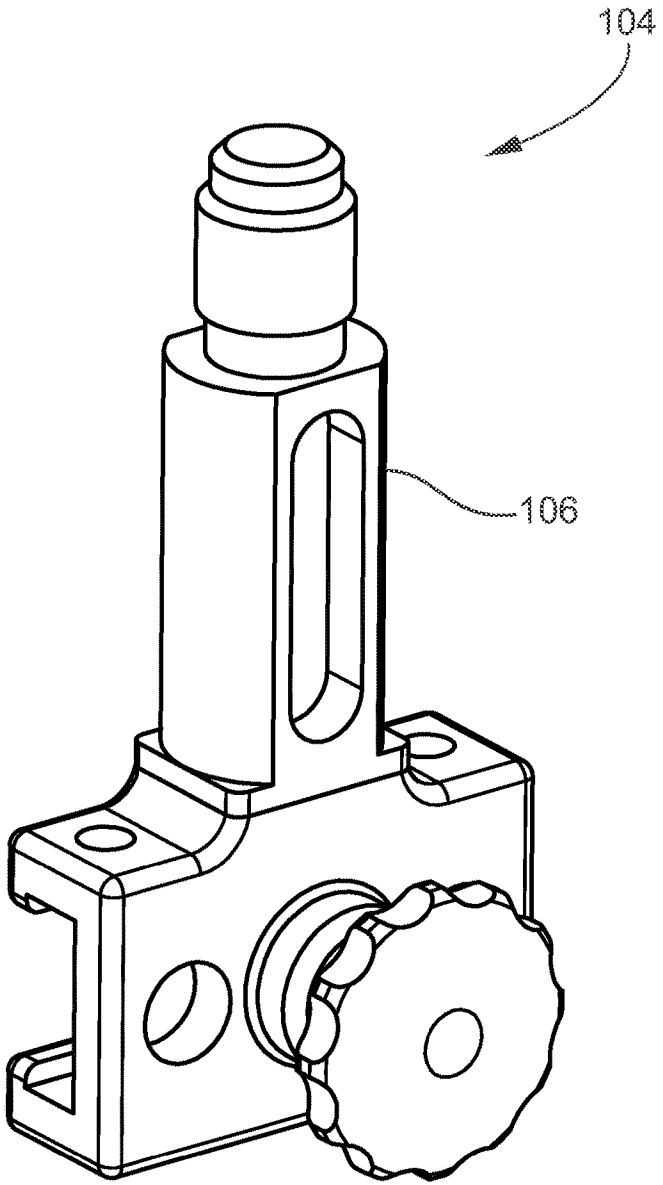
FIG. 3 is a perspective view of another embodiment of a rail clamp.

FIG. 3 is a perspective view of another embodiment of a rail clamp 104. Rail clamp 104 is identical in all respects to rail clamp 84 except clamp 104 uses a longer, extended stud 106. Extended stud 106 is useful to mount a medical device vertically higher above the frame assembly 10 than is possible with stud 98 of clamp 84.

Figure 4A:
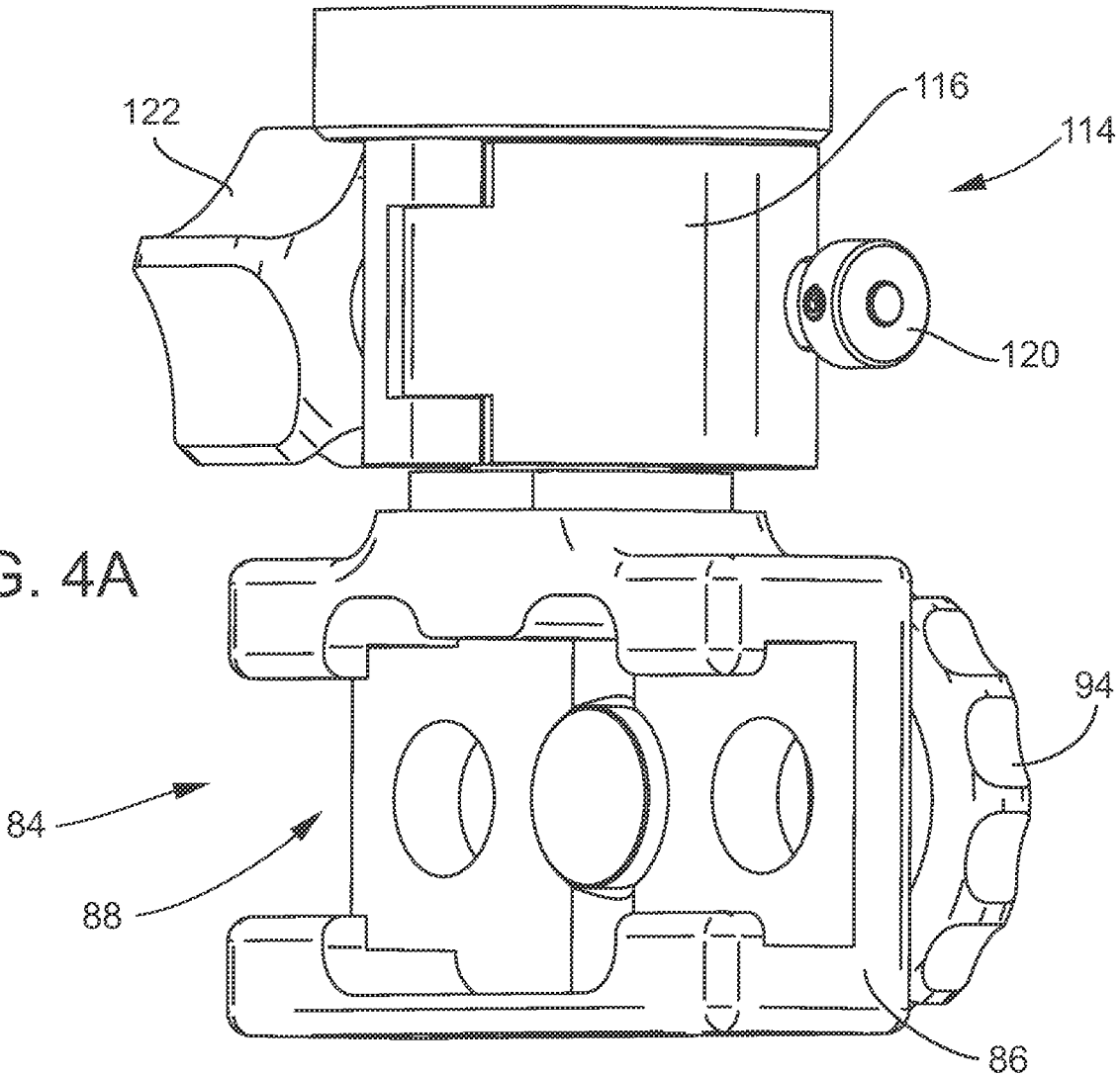
FIG. 4A is a perspective view of a medical device rotation assembly rotatably fixed to a rail clamp.

FIG. 4A is a perspective view of a medical device rotation assembly 114 rotatably fixed to rail clamp 84. Rotation assembly 114 may alternatively be rotatably fixed to rail clamp 104, if more height is needed as provided by extended stud 106. Rotation assembly 114 may enable 360 degree rotation of medical devices mounted to assembly 114. Assembly 114 releasably clamps to stud 98 by tightening or loosening knob 122.

Figure 4B:
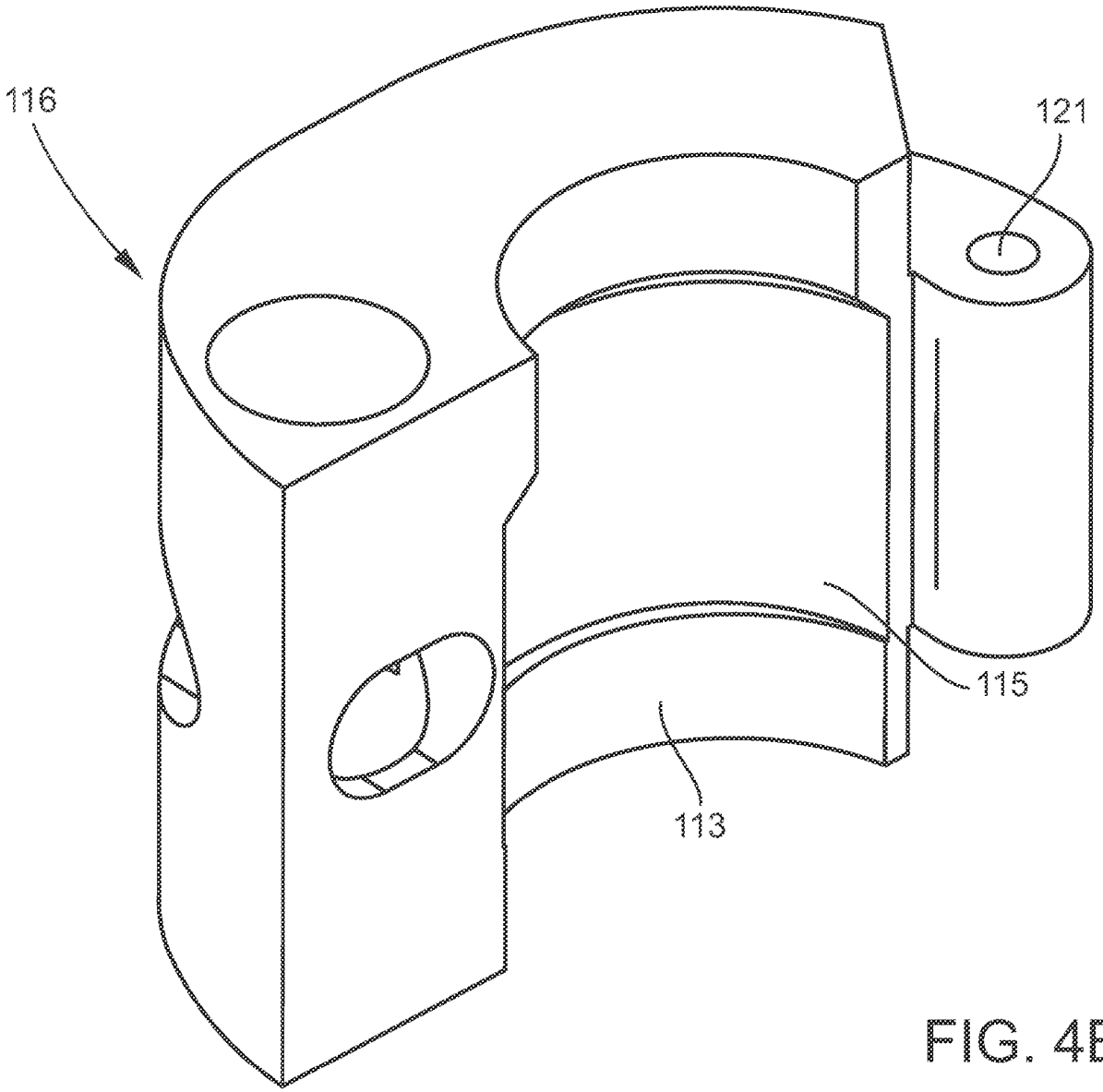
FIG. 4B is a perspective view of the interior of a clamp (not the rail clamp) used in the rotation assembly of FIG. 4A.
Figure 5B:
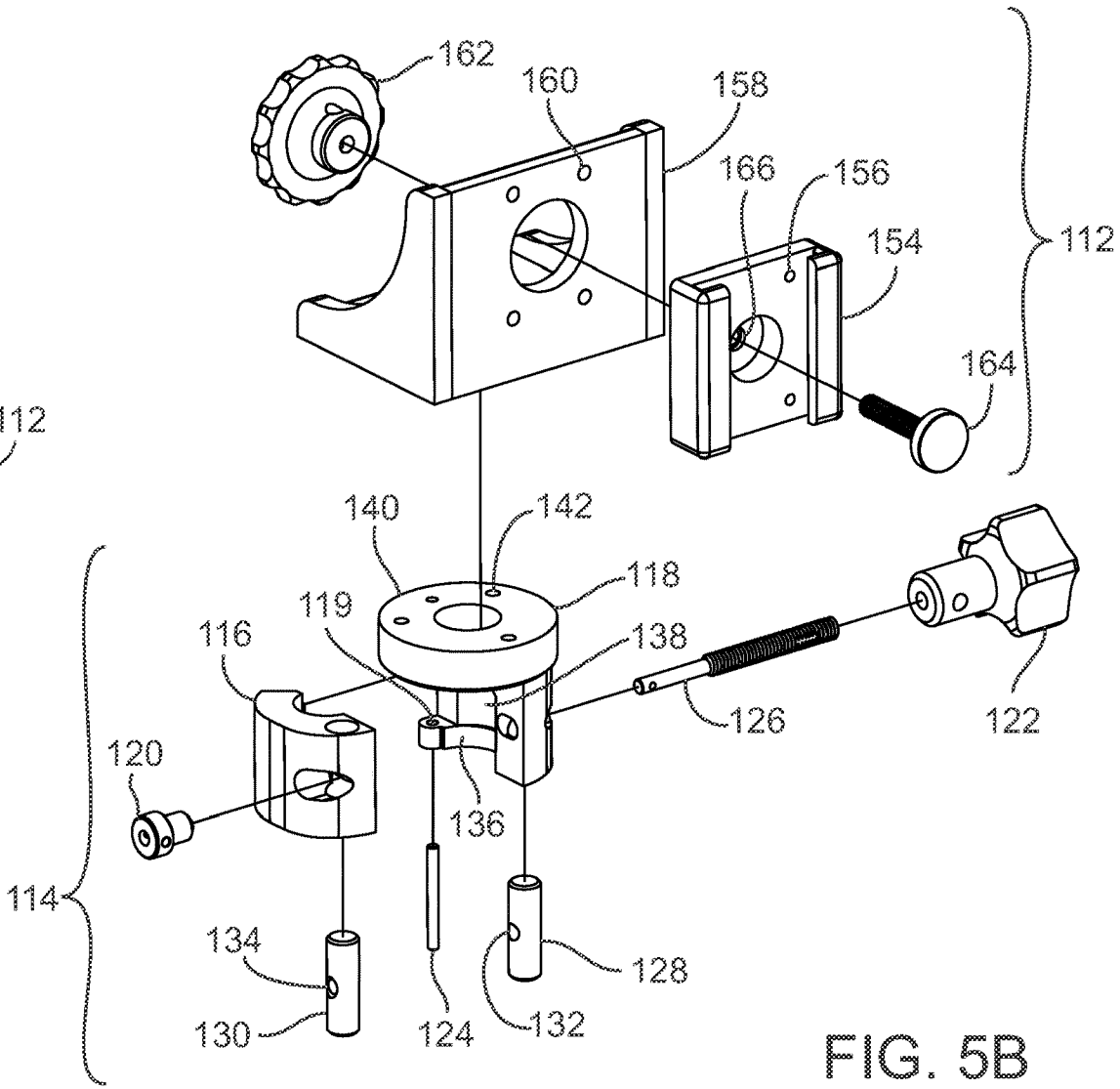
FIG. 5B is an exploded view of FIG. 5A
Figure 5A:
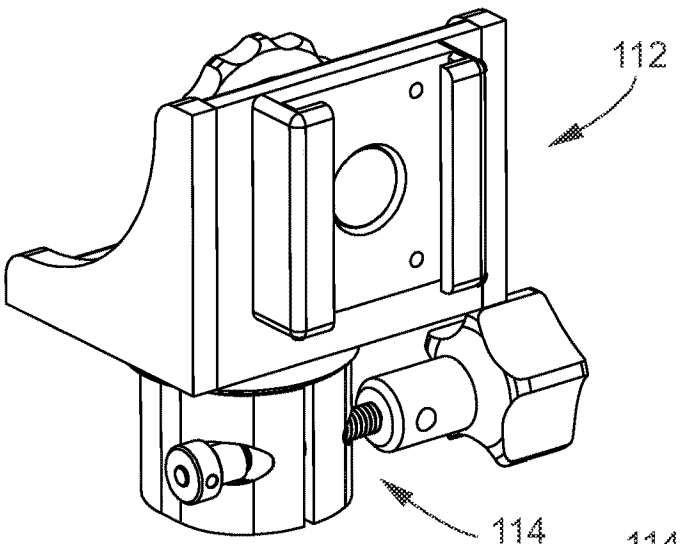
FIG. 5A is a perspective view of a medical device mount fixed to the rotation assembly of FIG. 4A.

FIG. 5A is a perspective view of a medical device mount 112 fixed to rotation assembly 114. FIG. 5B is an exploded view of FIG. 5A. Referring to FIG. 5B, boss 118 receives a pivot pin 128 having a threaded opening 132 and clamp 116 receives a pivot pin 130 having a loose fit opening 130. Threaded rod 126 is fixed to knob 122 and threadingly engages threaded opening 132 and extends loosely through opening 134 and out of clamp 116 where rod 126 is fixed to knob stop 120. So, tightening knob 122 results in boss 118 and clamp 116 pivoting on dowel 124 (FIG. 4B) so that assembly 114 tightens around stud 98. Dowel 124 fits in openings 119 (upper opening 119 not shown) in boss 118 and in opening 121 (FIG. 4B) of clamp 116 that clamp 116 and boss 118 can pivot on dowel 124 to loosen and tighten around stud 98.

Rotation assembly 114 also provides a constraint to vertical translation of assembly 114 with respect to stud 98. As discussed above with reference to FIG. 2B, the lower portion of stud 98 includes a smaller diameter portion 99 that is adjacent to a larger diameter portion 101. Referring now to FIG. 5B, boss 118 incudes a smaller inner diameter portion 136 adjacent to and below a larger inner diameter portion 138. As seen in FIG. 4B, the interior of clamp 116 also has a similar smaller inner diameter portion 113 and larger inner diameter portion 115, similar to the portions 136, 138 of boss 118. Thus, when assembly 114 is fixed around stud 98, the smaller inner diameter portions of boss 118 and clamp 116 mate with the small diameter portion 99 of stud 98. Thus, the stepped-up diameter portion 101 of stud 98 constrains vertical motion of assembly 114 on stud 98.

Figure 6A:
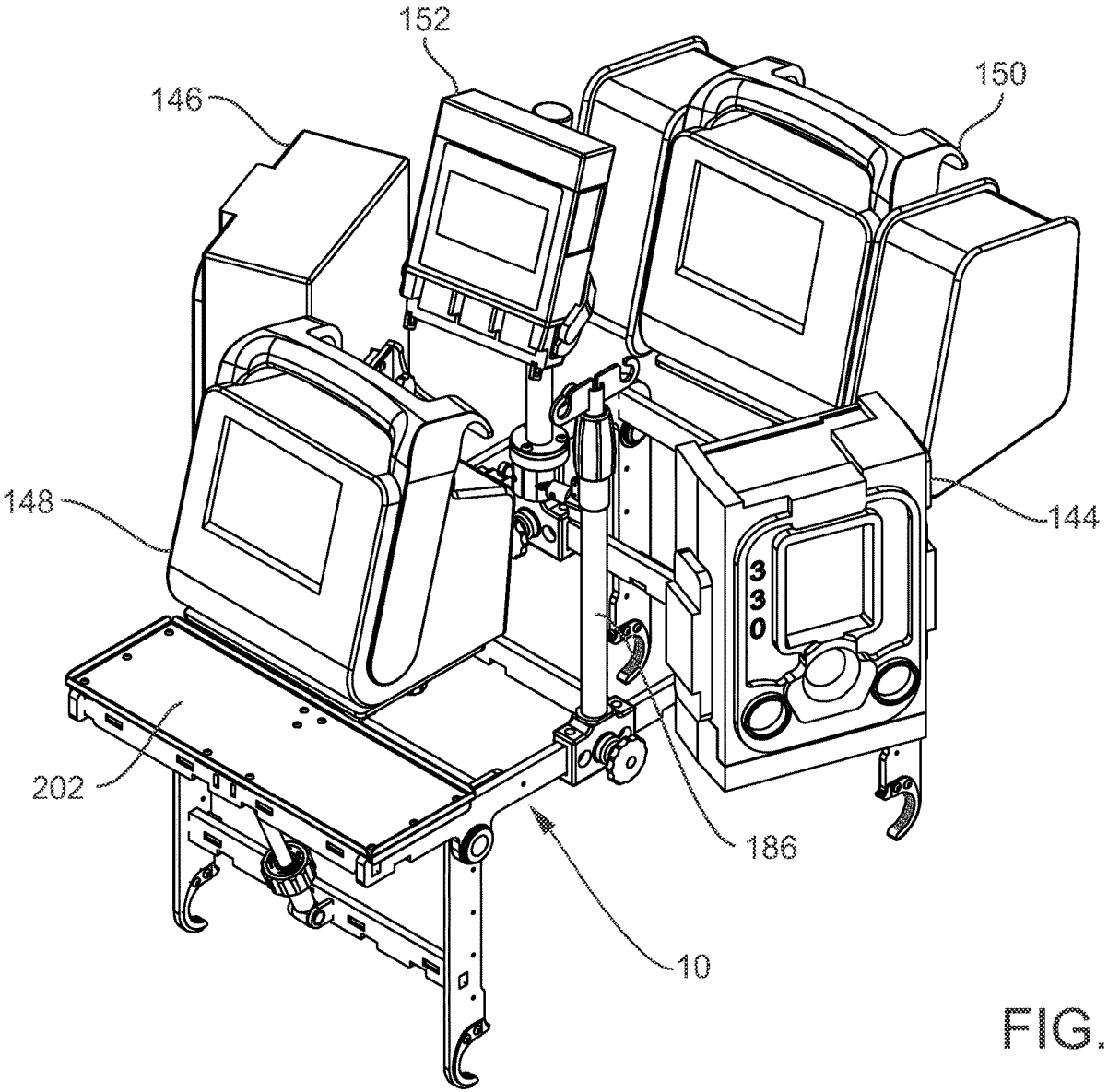
FIG. 6A is a perspective view of the frame assembly with medical devices mounted to the frame assembly.

In FIG. 5A, the medical device mount 112 is configured to receive an aspirator 144 or ventilator 146 (FIG. 6A). FIG. 5B shows boss 118 with a top surface 140. Attached to top surface 140 is medical device mount 112. Top surface 140 may be planar and may include a plurality of threaded openings 142 for receiving fasteners. Mount 112 may include an angle mount weldment 158 fixed to openings 142 in surface 140 with suitable fasteners (not shown). A T-mount fitting 154 is fixed to angle mount weldment 158 using fasteners (not shown) in openings 156 in the T-mount fitting 154 and openings 160 in angle mount weldment 158. The T-mount fitting includes a threaded opening 166 through which a threaded bolt 164 extends. A knob 162 is fixed on one end of threaded bolt 164 and the other end of bolt 164 is a disc for tightening against the mating mounting structure on an aspirator 144 or ventilator 146 (FIG. 6). The mount 112 may be used with a ZOLL® brand aspirator or respirator to provide a highly secure mount.

Figure 7B:
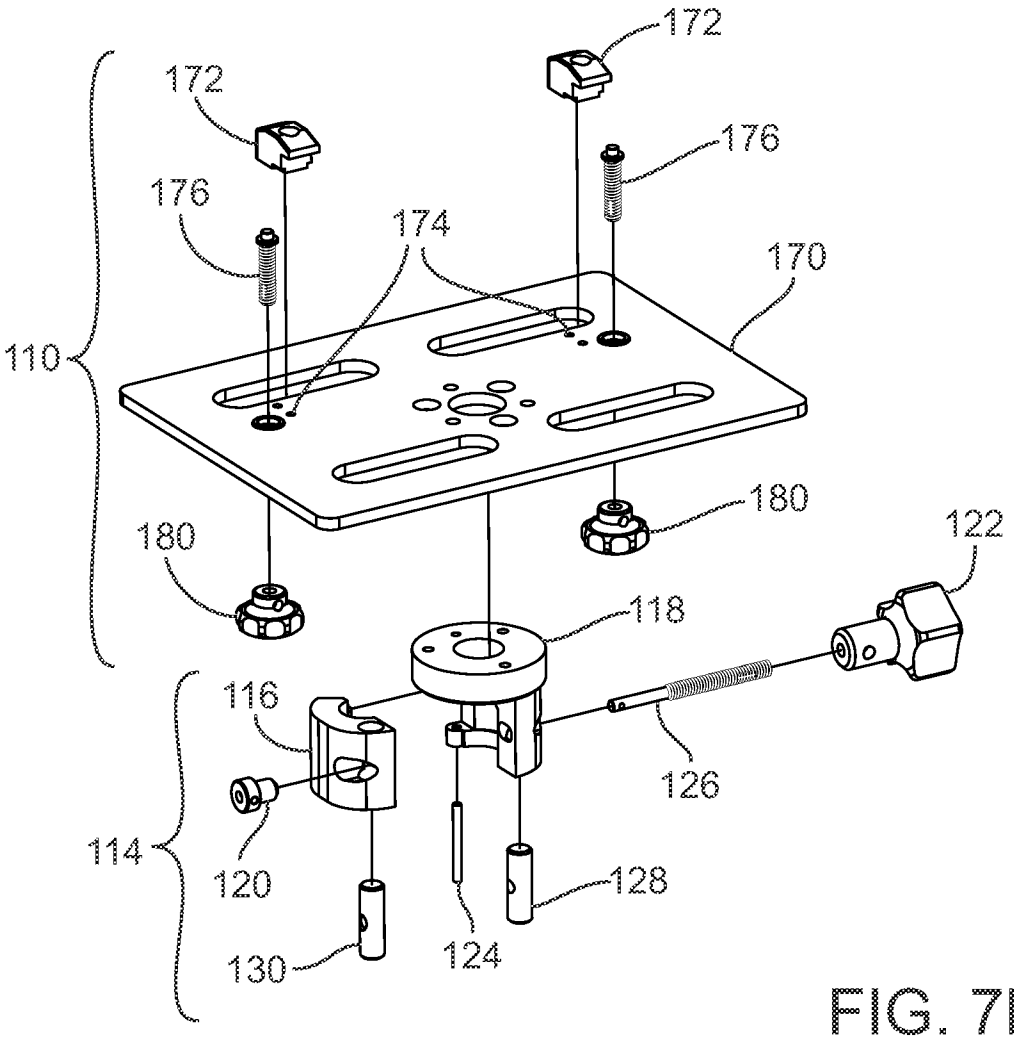
FIG. 7B is an exploded view of FIG. 7A
Figure 7A:
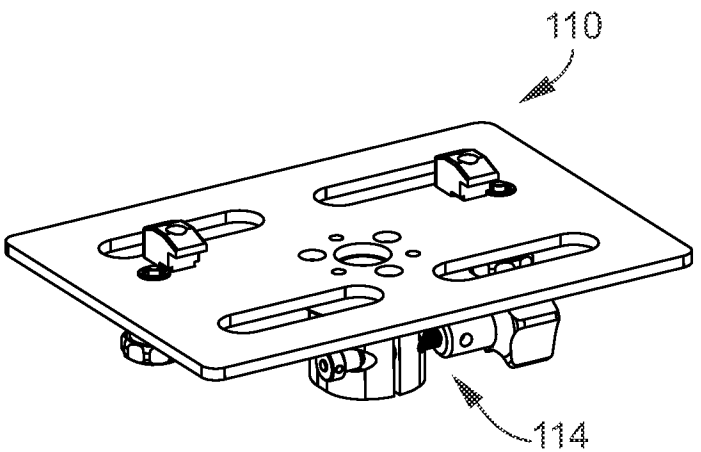
FIG. 7A is a perspective view of a medical device mount fixed to the rotation assembly of FIG. 4A.

FIG. 7A is a perspective view of a medical device mount 110 fixed to the rotation assembly 114 of FIG. 4A. FIG. 7B is an exploded view of FIG. 7A. In FIG. 7A, the medical device mount 110 is configured to receive a cardiac monitor 148 or a defibrillator 150 (FIG. 6A). FIG. 7B shows boss 118 with a top surface 140. Attached to top surface 140 is medical device mount 110. Top surface 140 may be planar and may include a plurality of threaded openings 142 for receiving fasteners. Mount 110 may include a platform assembly 170 fixed to surface 140 with fasteners (not shown) extending through openings in platform assembly 170 and openings 142 in surface 140. Two hold downs 172 are fixed to platform assembly 170 with fasteners (not shown) that extend through openings 174. Threaded openings 178 in platform assembly 170 receive threaded platform pins 176 that engage knobs 180 below platform assembly 170. The mount 110 may be used with a PROPAQ® brand cardiac monitor or defibrillator to provide a highly secure mount.

Figure 7D:
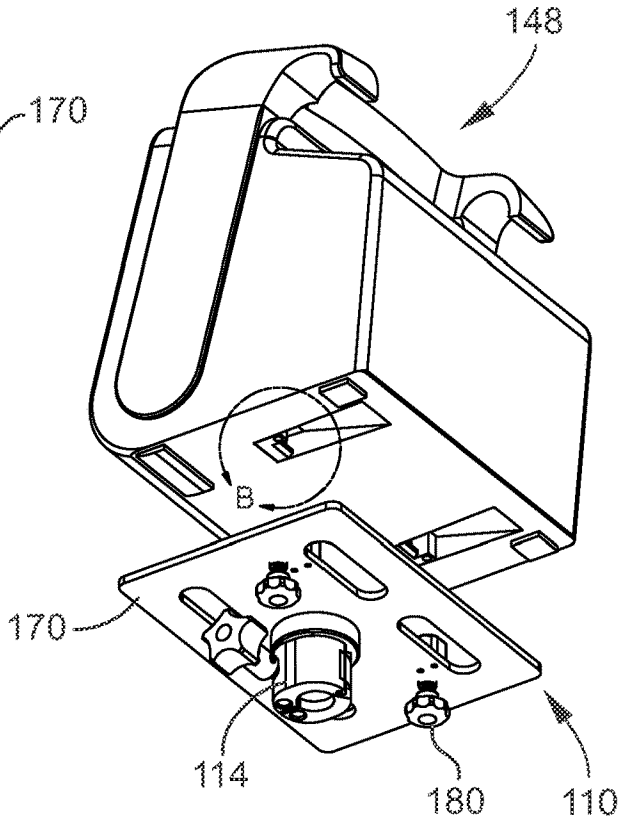
FIG. 7D is a bottom perspective view of FIG. 7C.
Figure 7E:
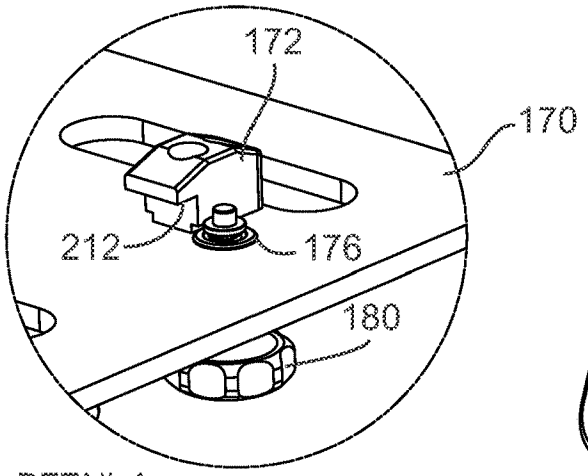
FIG. 7E is an enlarged view of a portion of FIG. 7C.
Figure 7F:
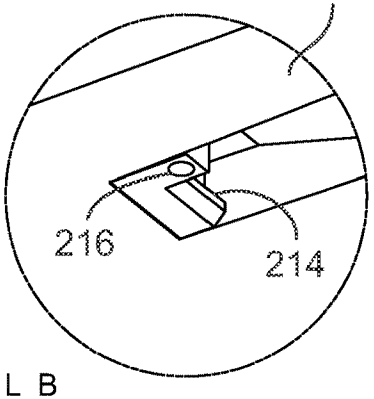
FIG. 7F is an enlarged view of a portion of FIG. 7D.
Figure 7C:
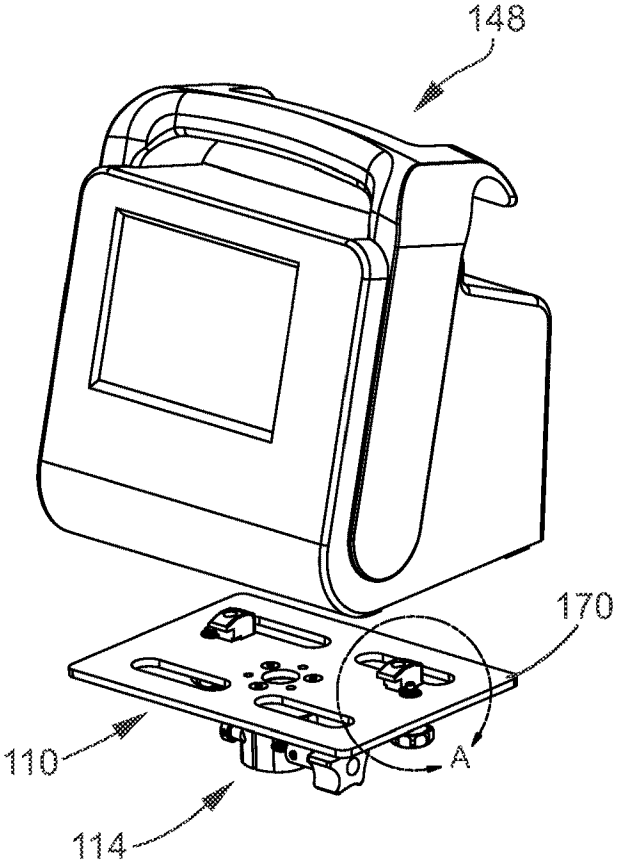
FIG. 7C is a perspective view of a cardiac monitor and the medical device mount of FIG. 7A.

FIG. 7C is a perspective view of a cardiac monitor 148 and the medical device mount 110 of FIG. 7A. FIG. 7D is a bottom perspective view of FIG. 7C. FIG. 7E is an enlarged view of a portion of FIG. 7C. FIG. 7F is an enlarged view of a portion of FIG. 7D. As shown in FIG. 7E, the hold downs 172 include an overhang 212 that mates with a gap above ledges 214 in the bottom surface of monitor 148. Platform pins 176 fit in holes 216 adjacent to ledges 214. Platforms pins 176 may be translated vertically by turning knobs 180 and thereby securely fastening hold downs 172 to the bottom of monitor 148.

Figure 8B:
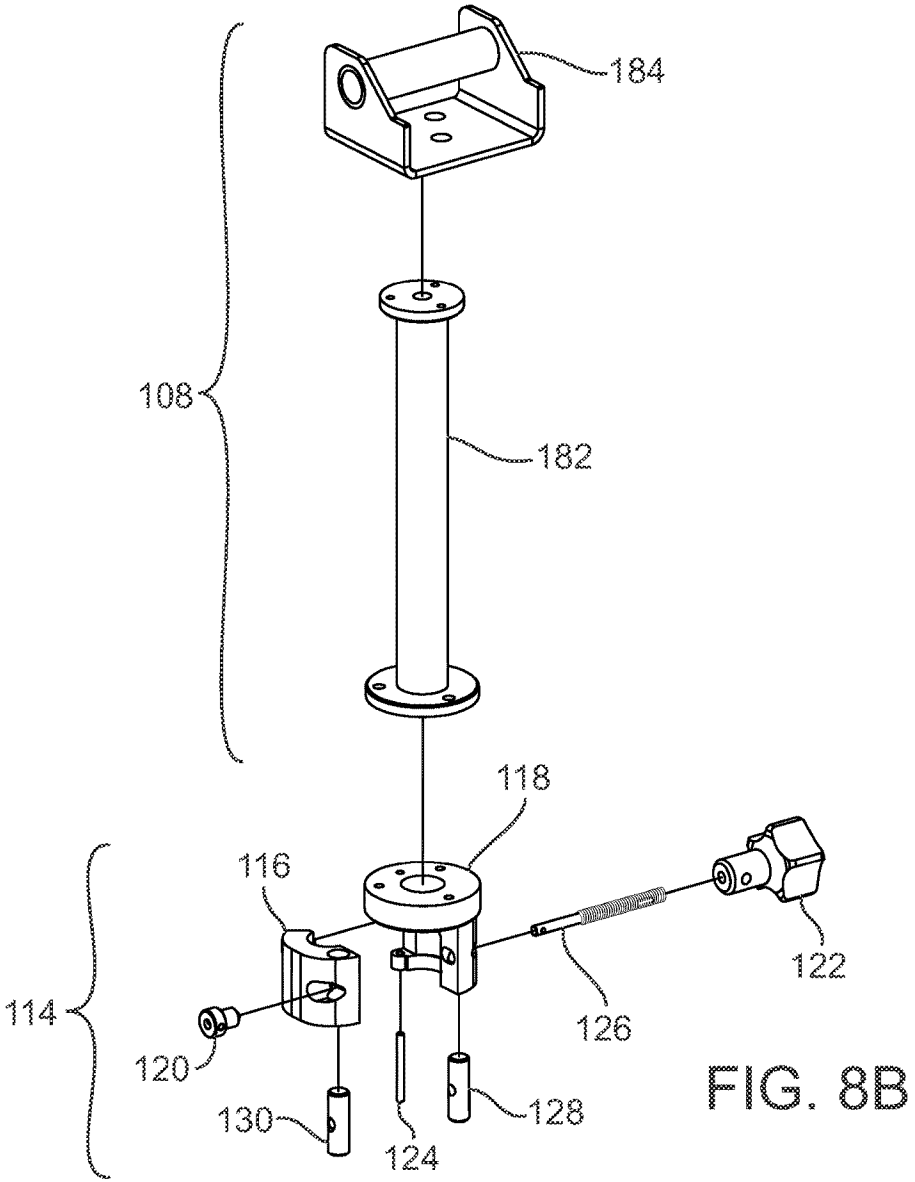
FIG. 8B is an exploded view of FIG. 8A.
Figure 8A:
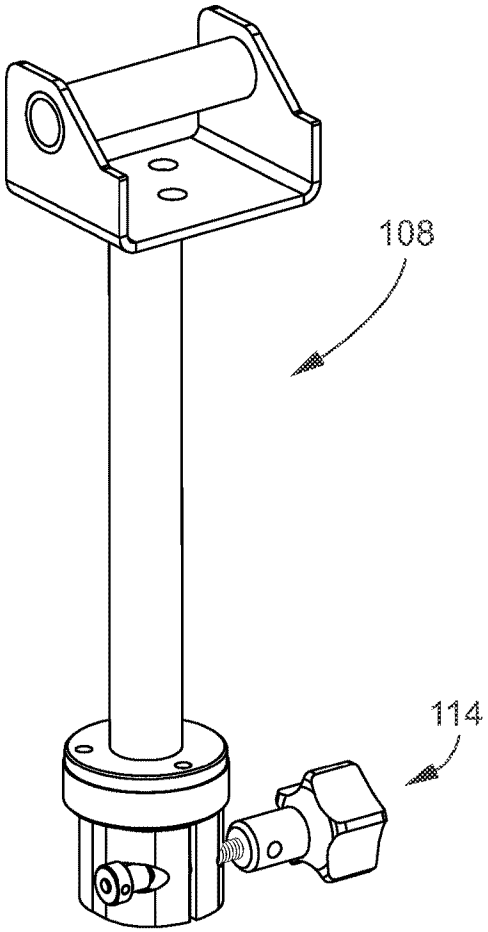
FIG. 8A is a perspective view of a medical device mount fixed to the rotation assembly of FIG. 4A.

FIG. 8A is a perspective view of a medical device mount 108 fixed to the rotation assembly 114 of FIG. 4A. FIG. 8B is an exploded view of FIG. 8A. In FIG. 8A, the medical device mount 108 is configured to receive an infusion pump 152 (FIG. 6A). FIG. 8B shows boss 118 with a top surface 140. Attached to top surface 140 is medical device mount 108. Top surface 140 may be planar and may include a plurality of threaded openings 142 for receiving fasteners. Mount 108 may include a pump pole 182 with its base fixed with fasteners (not shown) to surface 140. Fixed to a top surface of pump pole 182 is a pump yoke weldment 184. Weldment 184 may be fixed to pump pole 182 with fasteners (not shown). Pump yoke weldment 184 provides a highly secure mount for an infusion pump 152 (FIG. 6A).

Figure 9B:
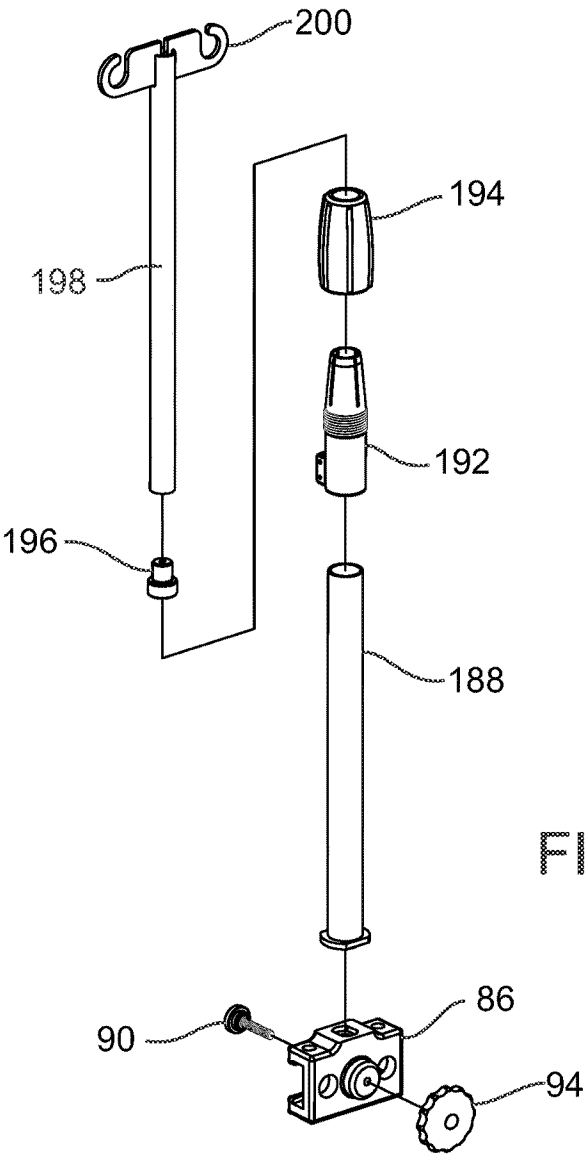
FIG. 9B is an exploded view of FIG. 9A.
Figure 9A:
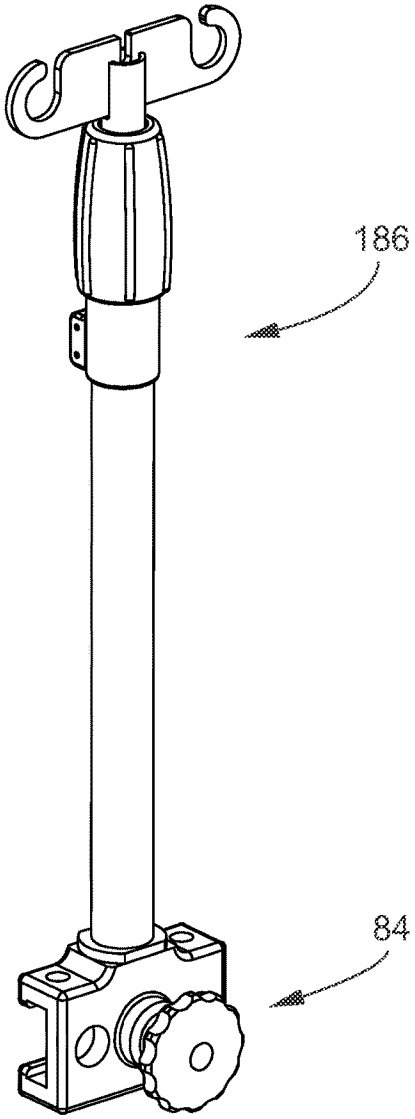
FIG. 9A is a perspective view of an IV pole assembly fixed to a rail clamp.
Figure 9C:
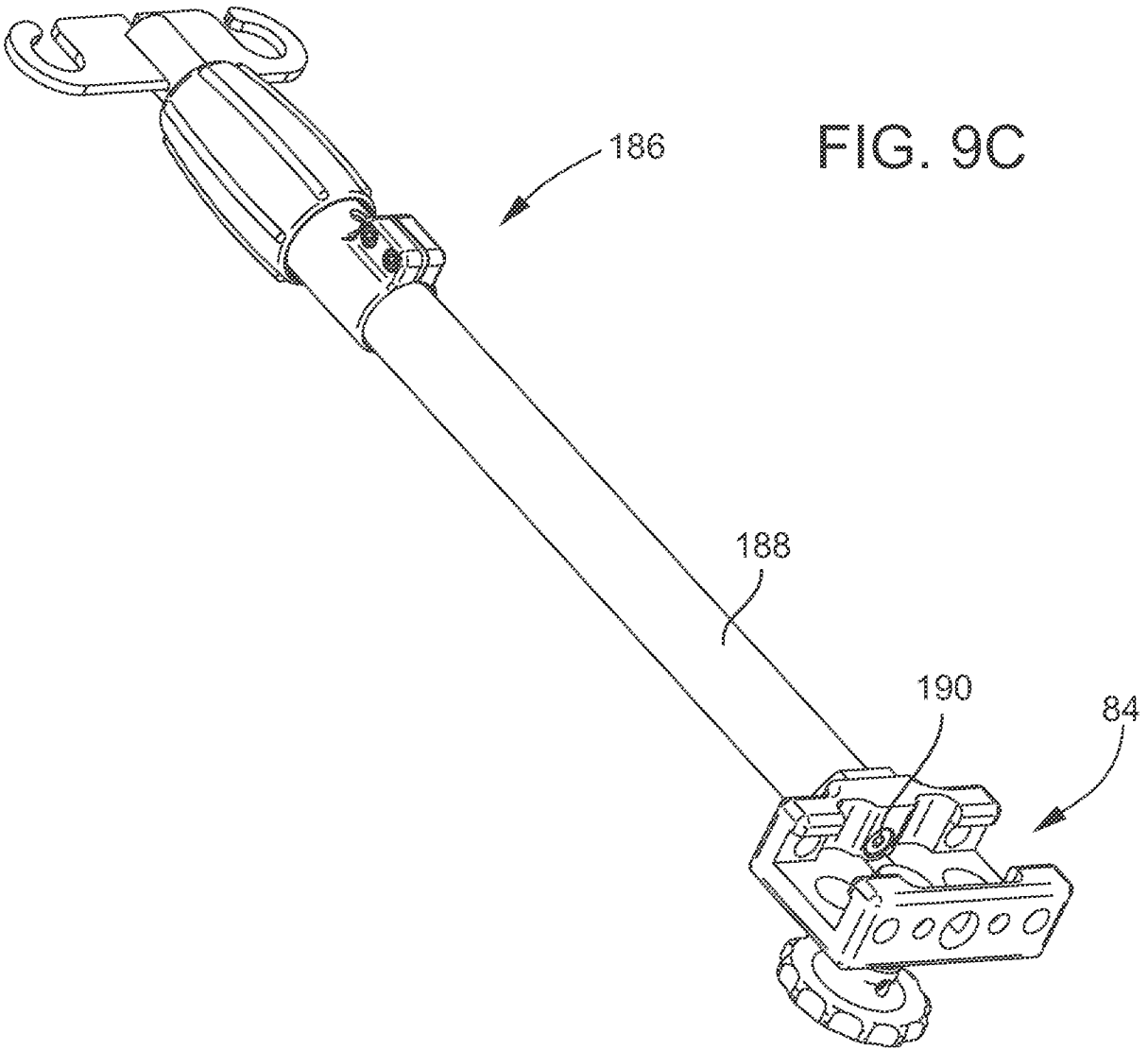
FIG. 9C is a bottom perspective view of the IV pole assembly of FIG. 9A.

FIG. 9A is a perspective view of an IV pole assembly 186 fixed to a rail clamp 84. FIG. 9B is an exploded view of FIG. 9A. FIG. 9C is a bottom perspective view of assembly 186. The IV pole assembly 186 has a lower pole 188 fixed to the rail clamp body 86 with a fastener 190 (FIG. 9C). An externally threaded compression bushing 192 is fixed to the lower pole 188 using a clamp 193. An internally threaded compression sleeve 194 engages the compression bushing 192. A slider 196 and an upper pole 198 are slidable and rotatable in the lower pole 188. An IV upper weldment 200 is fixed at a top of the upper pole 198 for holding, for example, IV bags. Loosening compression sleeve 194 from bushing 192 frees upper pole 198 for rotation and or vertical translation. Retightening sleeve 194 to bushing 192 fixes upper pole 198 in place.

Figure 10B:
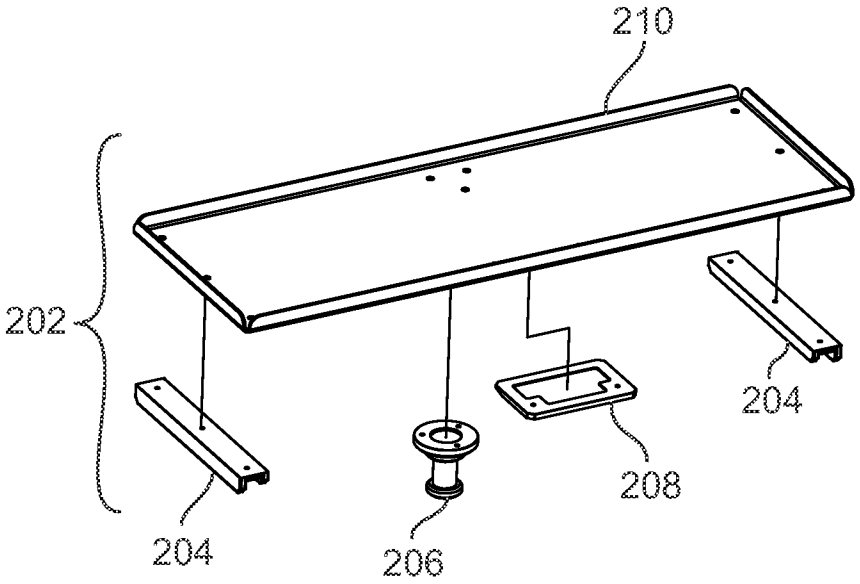
FIG. 10B is an exploded view of FIG. 10A.
Figure 10A:
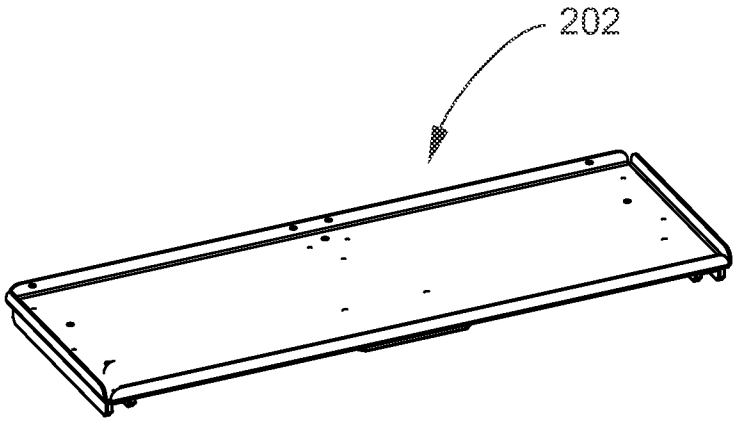
FIG. 10A is a perspective view of a tray assembly.

FIG. 10A is a perspective view of a tray assembly 202. FIG. 10B is an exploded view of FIG. 10A. Tray assembly 202 may include a pair of slider blocks 204 fixed to tray 210. Slider blocks 204 engage parallel rails 12, 14 (FIG. 6C) of frame assembly 10. A tray pin 206 is inserted in tensioner clip 74 when frame assembly 10 is in its open position, to fix tray 210 in position. A tray center piece 208 may be fixed to the bottom surface of tray 210 where tray 210 rests on transverse rail 20 (FIG. 1A). Tray 210 provides a horizontal surface for placing medical instruments or other devices.

Figure 6B:
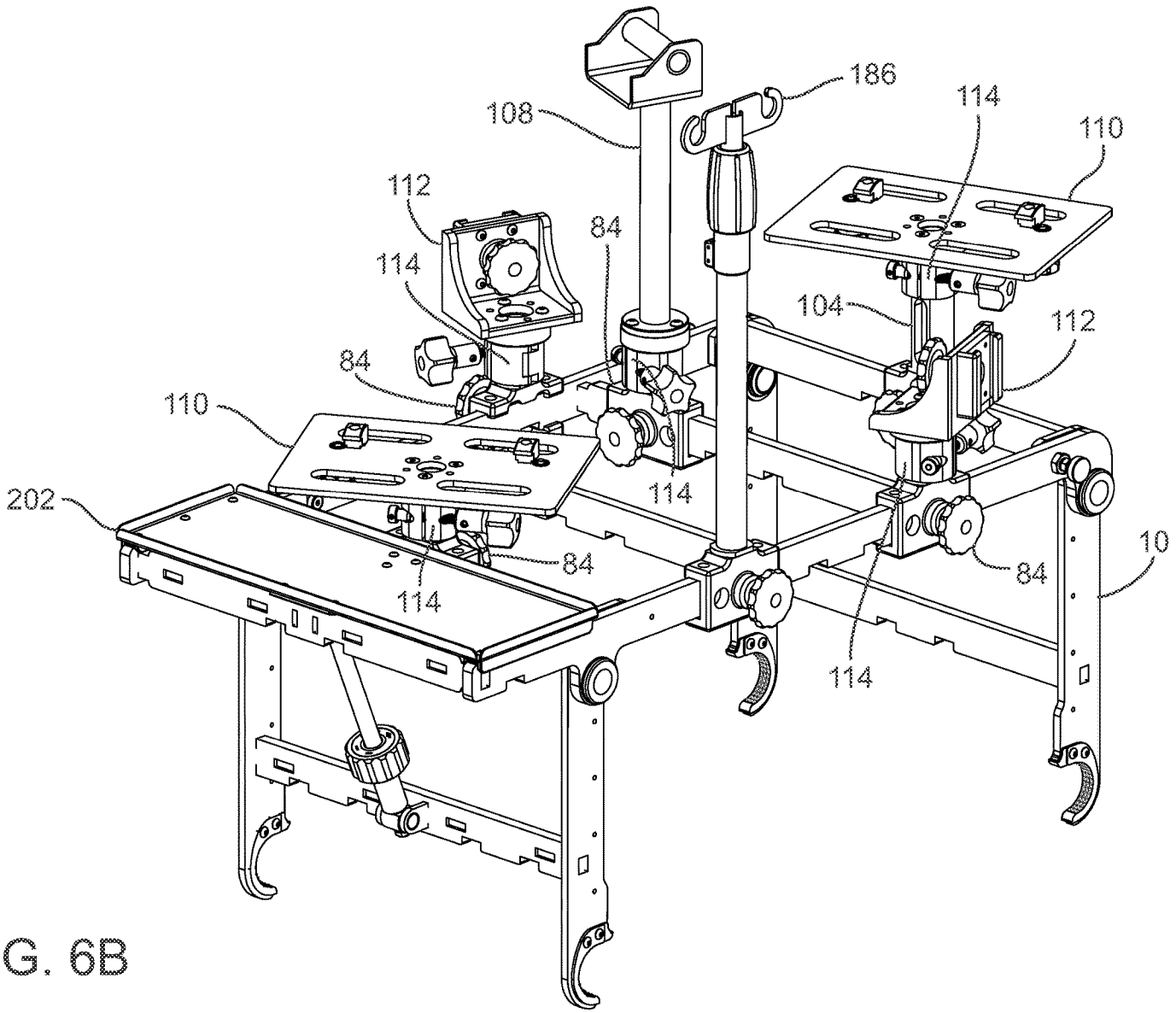
FIG. 6B is a perspective view of the frame assembly of FIG. 6A with the medical devices removed but showing the mounts for the medical devices fixed to the frame assembly.
Figure 6C:
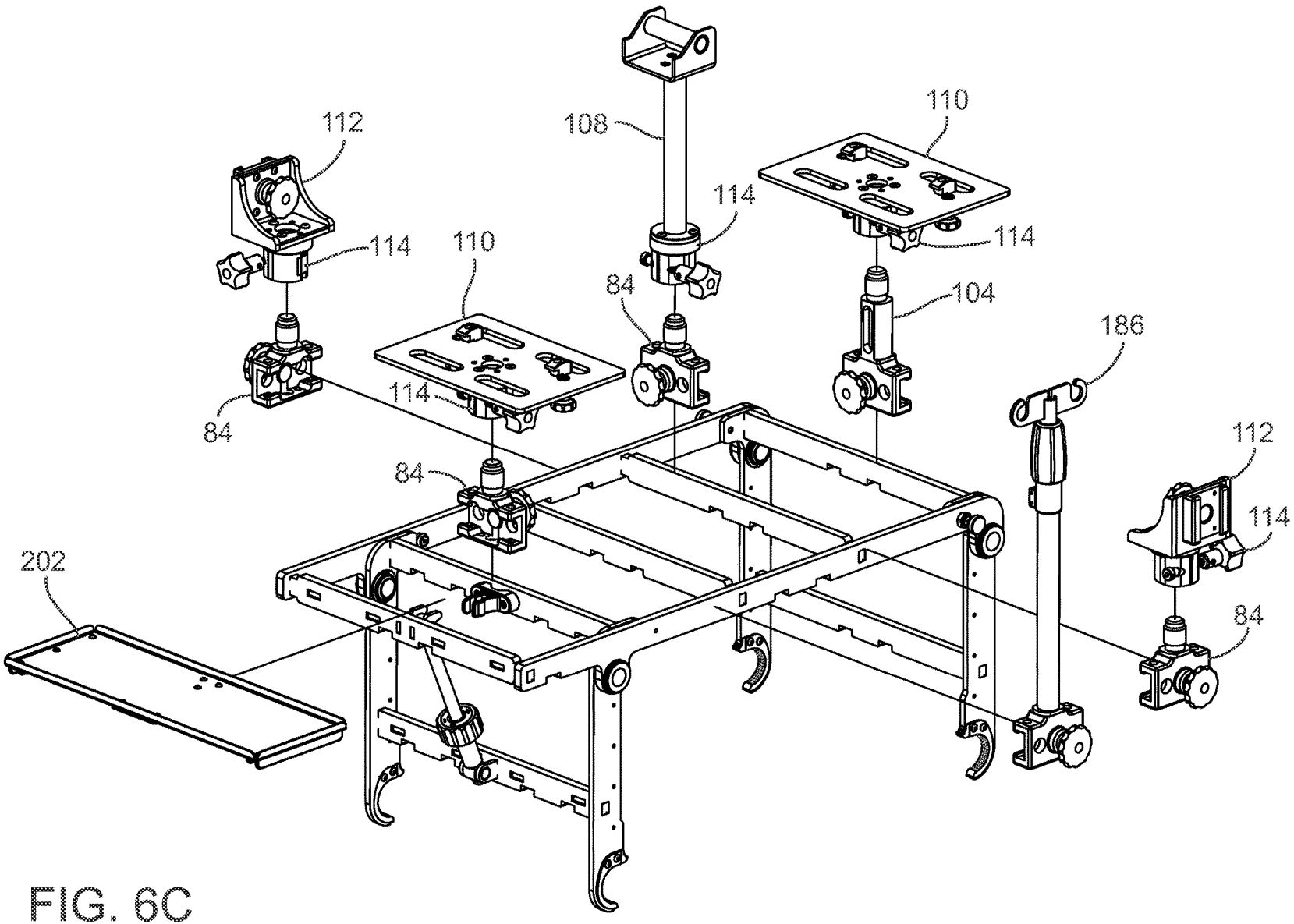
FIG. 6C is an exploded view of FIG. 6B.

FIG. 6A is a perspective view of the frame assembly 10 with medical devices such as a cardiac monitor 148, aspirator 144, ventilator 146, defibrillator 150, infusion pump 152, IV pole assembly 186 and tray assembly 202 mounted to the frame assembly 10. Of course, different combinations and/or numbers of medical devices may be mounted to frame assembly 10. Also, the medical devices may be mounted to frame assembly 10 in different locations than shown in FIG. 6A. FIG. 6B is a perspective view of the frame assembly of FIG. 6A with the cardiac monitor 148, aspirator 144, ventilator 146, defibrillator 150, and infusion pump 152 removed for clarity in showing the underlying medical device mounts for each medical device. FIG. 6C is an exploded view of FIG. 6B. FIG. 6D is a perspective view of the apparatus of FIG. 6B attached to a standard NATO litter 40 and FIG. 6E is an end view of FIG. 6D.

Figure 6E:
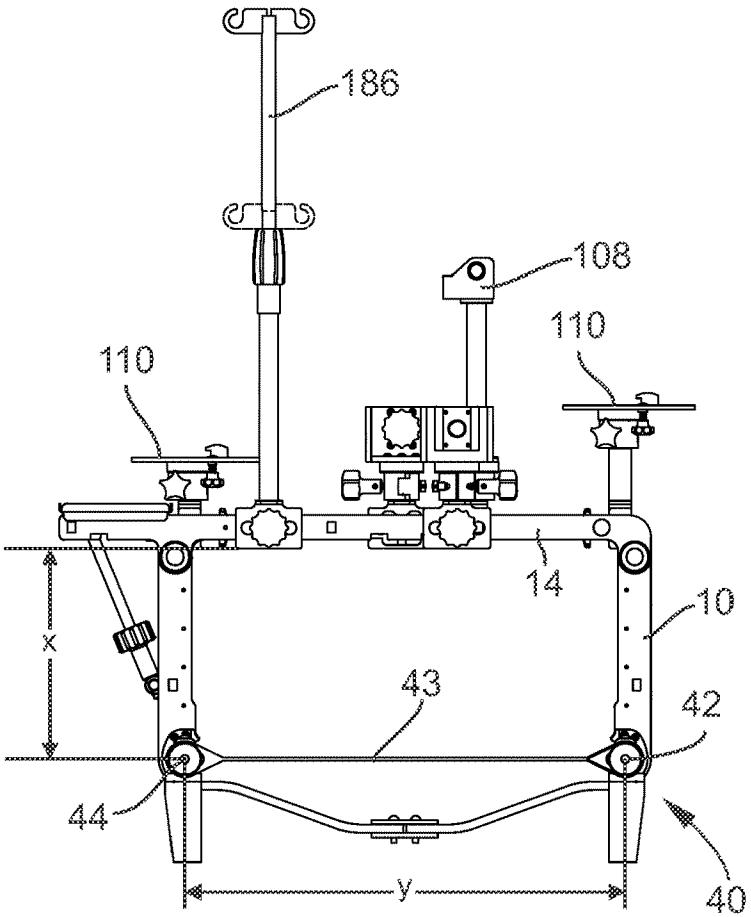
FIG. 6E is an end view of FIG. 6D.
Figure 6D:
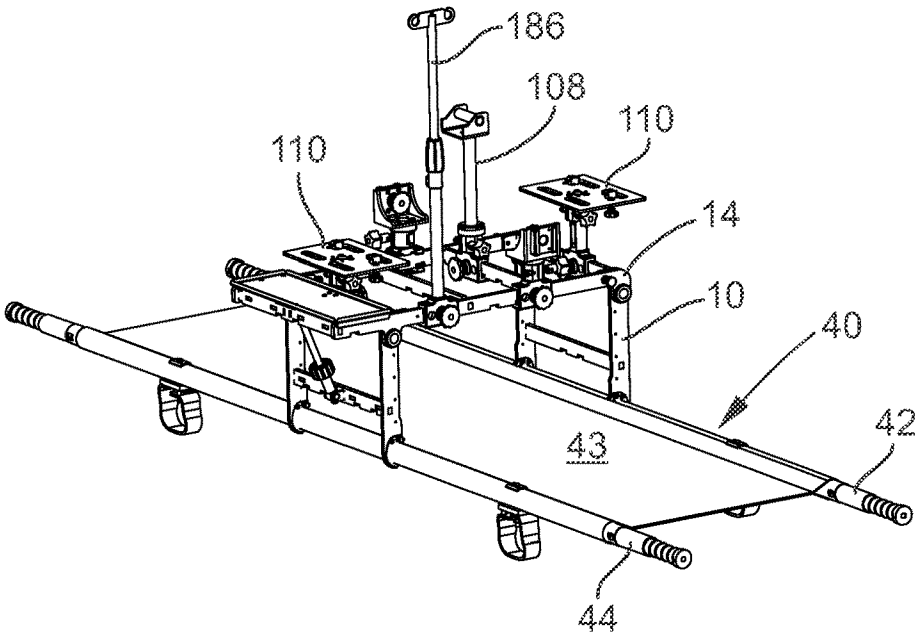
FIG. 6D is a perspective view of apparatus of FIG. 6B attached to a standard NATO litter.

As seen in FIG. 6E, the frame assembly 10 with attached mounts provides a patient clearance area with a width approximately equal to Y and a height of about X. Y is the distance between the centers of litter poles 44 and 42, which is generally 20 inches. X may be about 9.5 inches. As shown in the end view of FIG. 6E, there are no obstructions, hanging pins, etc. between the litter bed 43 and the parallel rails 12, 14 of frame assembly 10 so that the area for placing the patient is maximized. The construction of frame assembly 10 allows it to be used with some variation in the width of litter 40 and some variation in the diameter of the attachment points to poles 44 and 42.

Embodiments of the invention have been described to explain the nature of the invention. Those skilled in the art may make changes in the details, materials, steps and arrangement of the described embodiments within the principle and scope of the invention, as expressed in the appended claims.

What is claimed is:

1. An apparatus for mounting medical devices, the apparatus including a frame assembly, comprising:

a pair of parallel rails fixed to at least two transverse rails extending between the pair of parallel rails;

a pair of arm assemblies pivotally attached to opposing first and second ends of the pair of parallel rails;

each arm assembly including a pair of parallel arms with each arm including a clamp at a distal end for engaging a pole of a litter having a pair of parallel poles, each arm assembly including two transverse rails extending between the pair of parallel arms;

each arm depending downwardly and normal to a respective one of the pair of parallel rails in an open position of the frame assembly and extending parallel to the respective one of the pair of parallel rails in a folded position of the frame assembly;

a pair of retractable spring plungers inserted through respective openings in the first ends of the pair of parallel rails and through respective openings in proximal ends of the pair of parallel arms to lock the pair of parallel arms of the arm assembly at the first end of the parallel rails normal to the first ends of the parallel rails; and a tensioner assembly including a threaded rod with one end of the tensioner assembly pivotally attached to a lower one of the two transverse rails of the arm assembly at the second end of the pair of parallel rails and another end of the tensioner assembly disposed in a slotted receiver fixed to one of the at least two transverse rails extending between the pair of parallel rails.

2. The apparatus of claim 1, wherein each clamp has a concave surface for receiving a pole of the litter.

3. The apparatus of claim 2, further comprising the litter having the pair of parallel poles wherein each clamp engages one of the parallel poles.

4. The apparatus of claim 2, wherein the parallel rails and transverse rails have a cross-section of North American standard surgical rails.

5. The apparatus of claim 2, wherein the parallel rails and transverse rails have a cross-section of European standard surgical rails.

6. The apparatus of claim 2, further comprising a swing stop pin fixed to each parallel rail to limit rotation of the arm assembly at the second end of the parallel rails to a position in a range of five degrees to twenty degrees past a position that is perpendicular to the parallel rails.

7. The apparatus of claim 1, further comprising a rail clamp including a channel shaped to engage and slide along the parallel rails and the transverse rails.

8. The apparatus of claim 7, wherein the rail clamp includes a rail body having an internally threaded opening that engages an externally threaded fastener, the externally threaded fastener including a contact disc at one end that presses against one of the parallel or the transverse rails to secure the rail clamp from sliding along the one of the rails.

9. The apparatus of claim 8, wherein the rail clamp includes a stud fixed to the rail body for attachment of medical devices.

10. The apparatus of claim 9, further comprising a medical device rotation assembly rotatably fixed to the stud of the rail clamp.

11. The apparatus of claim 10, wherein the rotation assembly rotates 360 degrees on the stud.

12. The apparatus of claim 10, wherein the rotation assembly is constrained from vertical translation with respect to the stud.

13. The apparatus of claim 12, wherein the rotation assembly includes a boss and a clamp pivotally connected by a dowel, a first pivot pin with a threaded opening disposed in the boss, a second pivot pin with an unthreaded opening disposed in the clamp and a threaded rod that engages the threaded opening in the first pivot pin and extends through the unthreaded opening in the second pivot pin to an outside of the clamp.

14. The apparatus of claim 13, wherein the vertical translation is constrained by lower inner diameter portions of the boss and the clamp engaging a lower portion of the stud which has a diameter that is smaller than a diameter of an adjacent portion of the stud.

15. The apparatus of claim 14, wherein the boss includes a top surface, the apparatus further comprising a medical device mount fixed to the top surface.

16. The apparatus of claim 15, wherein the medical device mount is one of an infusion pump mount, a defibrillator/cardiac monitor mount and an aspirator/ventilator mount.

17. The apparatus of claim 8, further comprising an IV pole assembly fixed to the rail clamp, the IV pole assembly including a lower pole fixed to the rail clamp, an externally threaded compression bushing fixed to the lower pole, an internally threaded compression sleeve that engages the externally threaded compression bushing, an upper pole slidable and rotatable in the lower pole and an IV upper weldment at a top of the upper pole.

18. The apparatus of claim 1, further comprising a tray assembly disposed on the second ends of the pair of parallel rails.

19. The apparatus of claim 16, wherein the aspirator/ventilator mount incudes an angle mount weldment fixed to the top surface of the boss, a T-mount fitting fixed to the angle mount weldment, a threaded bolt extending through a threaded opening in the T-mount fitting, and a disc fixed to one end of the threaded bolt for tightening against an aspirator or ventilator.

20. The apparatus of claim 16 , wherein the defibrillator/cardia.c monitor mount includes a platform assembly fixed to the top surface of the boss, two hold downs fixed to the platform assembly, a pair of threaded platform pins that engage threaded openings in the platform assembly and a knob fixed to each of the pair of threaded platform pins.

21. The apparatus of claim 20, further comprising a defibrillator/cardiac monitor having a bottom surface wherein each hold down of the platform assembly includes an overhang that mates with a gap above a ledge in the bottom surface of the defibrillator/cardiac monitor, and the platform pins are received in holes in the bottom surface adjacent to the ledges and further wherein the platforms pins are vertically translatable into the holes in the bottom surface by turning the knobs to thereby securely fasten the hold downs to the bottom surface of the defibrillator/cardia monitor.

22. The apparatus of claim 16, wherein the infusion pump mount includes a pump pole with a base fixed with fasteners to the top surface of the boss and a pump yoke weldment fixed to a top surface of the pump pole.

* * * * *